United States Patent [19]

Siemon et al.

[11] Patent Number: 4,909,753

[45] Date of Patent: Mar. 20, 1990

[54] PATCH CONNECTOR

[75] Inventors: John A. Siemon, Watertown; Howard Reynolds, Waterbury, both of Conn.

[73] Assignee: The Siemon Company, Watertown, Conn.

[21] Appl. No.: 357,554

[22] Filed: May 26, 1989

Related U.S. Application Data

[63] Continuation-in-part of Ser. No. 118,756, Nov. 5, 1987, Pat. No. 4,834,669.

[51] Int. Cl.[4] ..... H01R 4/24

[52] U.S. Cl. ..... 439/395; 439/409; 439/417

[58] Field of Search ..... 439/391, 395, 409, 410, 439/417, 456, 467, 596, 686, 687

[56] References Cited

U.S. PATENT DOCUMENTS

| | | | |
|---|---|---|---|
| 3,835,444 | 9/1974 | Plana et al. | 339/98 |
| 3,835,445 | 9/1974 | Hardesty | 339/99 R |
| 3,936,933 | 2/1976 | Folk et al. | 29/628 |
| 4,023,879 | 5/1977 | Braund et al. | 439/465 |
| 4,076,365 | 2/1978 | Ross et al. | 339/107 |
| 4,095,862 | 6/1978 | Hatch | 339/97 R |
| 4,125,137 | 11/1978 | Shatto Jr. | 140/147 |
| 4,145,103 | 3/1979 | Knowles | 339/99 R |
| 4,163,598 | 8/1979 | Bianchi et al. | 439/467 |
| 4,169,648 | 10/1979 | Moist Jr. | 439/467 |
| 4,191,444 | 3/1980 | Smith et al. | 439/467 |
| 4,252,396 | 2/1981 | Wilson | 339/99 R |
| 4,261,633 | 4/1981 | Abernethy | 339/97 P |
| 4,447,106 | 5/1984 | Houty et al. | 339/126 R |
| 4,455,058 | 6/1984 | Harner et al. | 439/409 |
| 4,460,229 | 7/1984 | Matthews | 339/99 R |
| 4,585,290 | 4/1986 | Knickerbocker et al. | 439/395 |
| 4,614,028 | 9/1986 | Rich | 29/749 |
| 4,701,138 | 10/1987 | Key | 439/417 |
| 4,759,723 | 7/1988 | Siemon | 439/409 |

FOREIGN PATENT DOCUMENTS

| | | | |
|---|---|---|---|
| 2854903 | 7/1979 | Fed. Rep. of Germany | 439/459 |

OTHER PUBLICATIONS

Thomas & Betts, Field-Installable Station Wire Connector System Brochure, 1985.

*Primary Examiner*—Joseph H. McGlynn
*Attorney, Agent, or Firm*—Fishman, Dionne & Cantor

[57] ABSTRACT

The patch connector comprises separable upper and lower housing portions and a double detent structure for joining the two oppositely disposed housing portions. The housing portions are snapped together to define a housing having exposed contacts on a front face thereof for accessing terminals from a terminal block; and at least one opening on the back face thereof for entry and exit of a cable or individual wires. The interior of the housing is provided with structure for retaining isolated electrical connector clips. Among other applications, the patch connector may be used as a means to electrically connect multiple insulated wires on terminals of a terminal block.

19 Claims, 5 Drawing Sheets

PATCH CONNECTOR

Cross-Reference to Related Application

This application is a continuation-in-part of application Ser. No. 118, 756 filed Nov. 5, 1987, now U.S. Pat. No. 4,834,669.

BACKGROUND OF THE INVENTION

This invention relates to an electrical connector intended for use with terminal blocks commonly employed as a means of connection for wire networks. More specifically, this invention relates to an alternate means of making electrical connection between wire and terminal points without the aid of tools or soldering.

While the connection points on the terminal block may be capable of terminating wire directly; via a solder joint or insulation displacement, the patch connector provides a means for making additional connections for temporary or long term use. Once wired, the invention is a multiple wire connector that my be installed and removed from the terminal block for the purpose of branching off existing lines or connecting together discrete areas of the terminal field.

In the communications industry, and more particularly in the telephone and data transmission industry, terminal blocks having a plurality of clip type electrical connectors or terminals protruding therefrom are commonly used. One such terminal block is the well known type 66 quick connect block. Having become widely accepted over the last twenty years, the 66-type quick connect blocks have evolved into many shapes and sizes and have been the focal point of a variety of accessories and adapters. Examples of some common adapters offered on the market are quick-connect clips that press onto the 66 terminals and may be terminated in the same manner as the base terminals. These adapters have several limitations. For example, they cannot terminate stranded wire, they require the use of a special tool and cannot be easily relocated without risk or damage to the wire interface or of shorting the tip and ring conductors.

Test adapters that press onto the front of the terminal block are widely used to connectorize the terminals with modular jacks on other industry standard connectors. The limitation of these devices is that they cannot be field wired and they cannot be mounted end to end or side to side without missing terminal locations that may require access. An example of such a test adapter is described in U.S. Pat. No. 4,585,290, which is assigned to the assignee hereof. Other examples of prior art test adapters are discussed in U.S. Pat. No. 4,585,290.

Improved terminal block patching devices which allow for field wiring are disclosed in U.S. application Ser. Nos. 879,593 filed June 27, 1986 (now U.S. Pat. No. 4,759,723) and 118,756 filed Nov. 5, 1987 (now U.S. Pat. No. 4,834,669), both of which are assigned to the assignee hereof and incorporated herein by reference. While well suited for their intended purposes, these prior patch connectors are designed primarily for use in connection with terminal blocks incorporating type 66 terminals. However, there is a need for a low cost and reliable patch connector which can be field terminated and which can be used with other types of terminal blocks. In particular, a patch connector is needed which can mate with the terminal block disclosed in U.S. application Ser. No. 144,040 filed Jan. 15, 1988.

SUMMARY OF THE INVENTION

The above discussed and other problems and deficiencies of the prior art are overcome or alleviated by the patch connector of the present invention. In accordance with the present invention, the patch connector comprises two separable upper and lower body or housing portions and a double detent structure for joining the two housing portions. In addition, this double detent structure permits the two body portions to be initially connected in a preliminary mode wherein the separate conductive wires (correspondng to the number of connector clips) may be loaded into retaining structure. After this initial attachment, and subsequent wire arrangement, the two body portions are snapped into a final connection mode wherein the individual conductors are simultaneously stripped of insulation thereby leading to electrical and mechanical connection between the electrical connector clips and the individual conductors.

An important feature of the present invention is that the front portion of the two-piece housing is specifically configured for use in conjunction with certain terminal blocks which are not populated with 66 type connector clips. In particular, the front portion of the patch connector of this invention comprises an alternating arrangement of elongated members or finger-like projection and is thereby well suited for use in mounting on a terminal block of the type disclosed in aforementioned U.S. patent application Ser. No. 144,040 filed Jan. 15, 1988.

The patch connector of the present invention is preferably configured in multiples of two such that the two conductors which constitute a line may be kept together, yet cannot be shorted.

Other features of this invention include the ease of field assembly without special tools or operations, (e.g. soldering or crimp tools), polarization means which assures proper orientation of the mating conductors, a snap detent means that provides a positive and stable mechanical connection to the connecting block; a means of temporarily rerouting connections made internal to the connecting block and an improved insulation displacement terminal which utilizes the preferred closed gap construction.

One embodiment of the patch connector of the present invention includes a means of rerouting connection paths by disabling bridging contacts internal to a connecting block while simultaneously establishing a new electrical connection with its internal connecting clips.

The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

Figure 1:
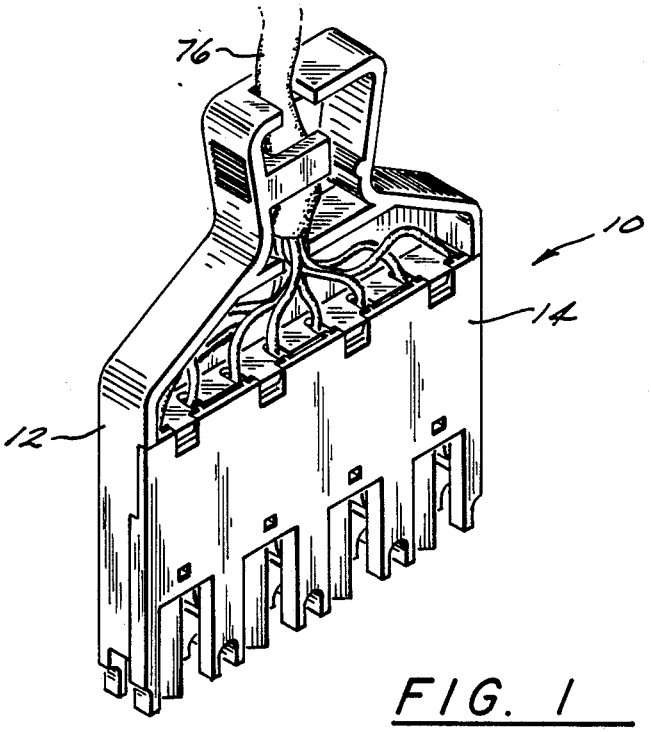
FIG. 1 is a perspective view of a wired and assembled patch connector in accordance with the present invention.
Figure 2:
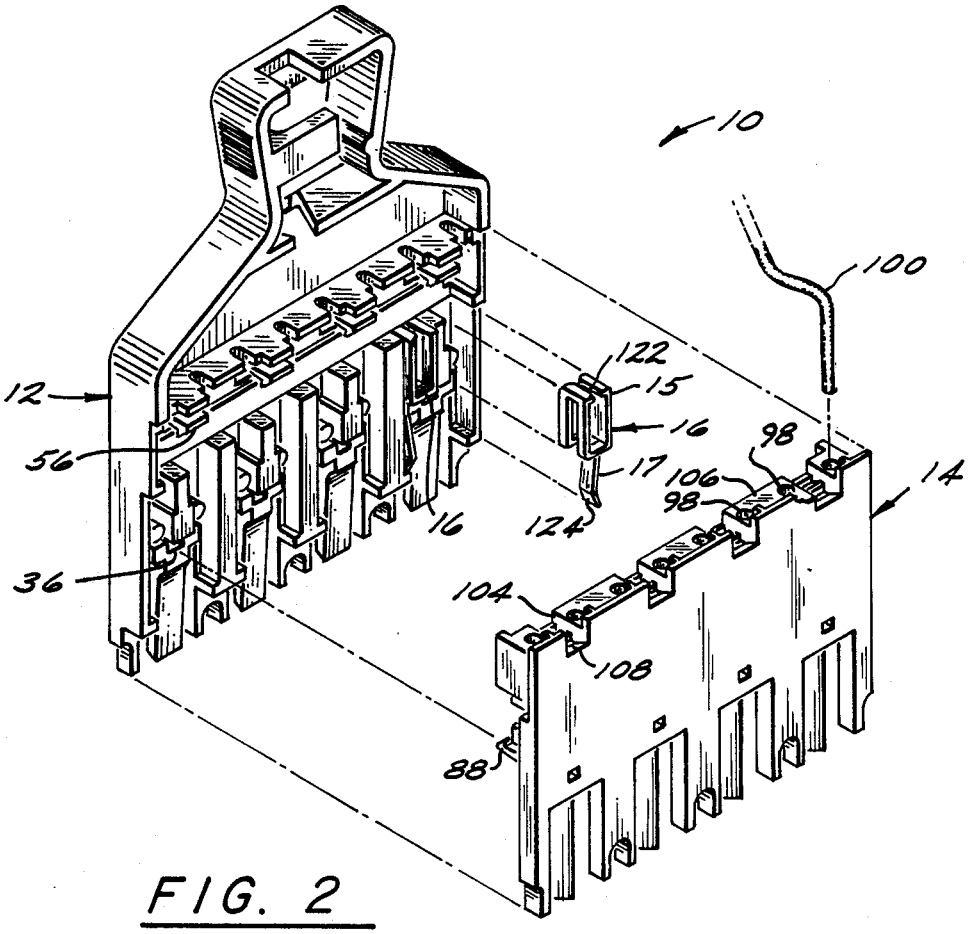
FIG. 2 is an exploded view of the patch connector of FIG. 1.

DESCRIPTION OF THE PREFERRED EMBODIMENT:

Referring first to FIG. 1, a patch connector in accordance with the present invention is shown generally at 10 subsequent to assembly thereof. As shown in FIG. 1 and the exploded view of FIG. 2, patch connector 10 is comprised of a preferably insulative plastic housing comprised of two separable parts, a lower first housing or mainbody section 12 and an upper second housing or cover section 14. Lower housing section 12 is shown in detail in FIGS. 3–6 and upper housing section or cover plate 14 is shown in detail in FIGS. 7–12. Patch 10 also includes a plurality of connector clips 16 (only two of which are shown in FIG. 2).

Turning now to a discussion of the lower housing section, housing section 12 is comprised of a non-conductive body which includes a front face (FIG. 5) having a plurality of connector housing sections 18. Each connector housing section 18 includes a pair of recesses 20 which house a pair of connector clips 16. In turn, each connector clip generally includes a rectangular-body 15 and a flattened resilient contact member 17 extending from body 15. It will be appreciated that while the FIG. 1 embodiment includes four connector housing sections (a four pair patch connector), the present invention contemplates any number of connector housing sections therein. However, these sections are generally numbered in pairs (2, 4, 6 or 8) when used in the communications and more particularly the telephonic field.

Figure 3:
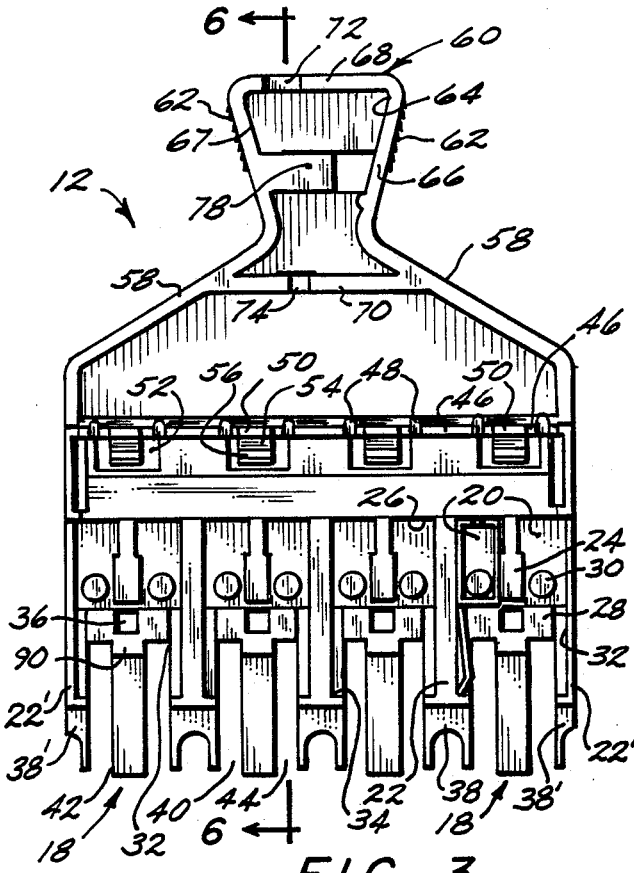
FIG. 3 is a plan view of the lower body portion of the patch connector of FIG. 1.

As mentioned, each housing section includes a pair of recesses 20. Each recess 20 is defined by a T-shaped side wall 22, an opposed sidewall 24, a rear wall 26 and a front body 28. It will be appreciated that the two outermost walls 22′ have a 1/2 T configuration in contrast to the corresponding full T-shaped walls 22. A cylindrical protrusion 30 extends upwardly from the floor of recess 20 and is positioned to form small gaps respectively between walls 22, 24 and body 28. As shown in FIGS. 2 and 3, recess 20 is configured to receive and frictionally retain the body 15 of a contact 16. A groove 32 is defined between side wall 22 and body 28. Groove 32 is configured to permit contact member 17 to pass therethrough. In addition, the T portion of wall 24 defines a shoulder 34 for abutment with the terminal end of contact member 17. Note that each pair of adjacent bodies 28 includes a square opening 36 therethrough.

In general, the front end of lower housing section 12 has a terminal configuration comprised of a repeating sequence of a U-shaped extension 38, a first rectangular opening 40, a flattened rectangular blade 42 and a second rectangular opening 44. The T-shaped walls 22 are integral and aligned with U-shaped extensions 38. Similarly, sidewalls 24 are aligned with blades 42 (as well as openings 36). Note that each end wall 22′ is integral and aligned with an end member 38′ having a ½ U configuration.

The U-shaped terminations on extensions 38 are important when patch 10 is used on a terminal block of the type disclosed in U.S. Ser. No. 144,040 filed Jan. 15, 1988. The opposed legs on each U-shaped member acts to disconnect or disable an internal bridging means on the terminal block of U.S. Ser. No. 144,040 subsequent to connect of patch 10 on said terminal block.

At about the mid-point of lower housing section 12 are a plurality (e.g. seven) of spaced, aligned flattened tabs 46 separated by wire retaining grooves 48. The first, third, fifth and seventh tab 46 include additional extension 50 having a narrower width relative to the width of tabs 46. A rectangular aperture 52 is formed through lower housing portion 12 immediately in front of the first, third, fifth and seventh tabs 46. A resilient arm 54 terminating at a detent member 56 extends outwardly and angularly from the first, third, fifth and seventh tabs 46 in the space above each aperture 52.

Figure 4:
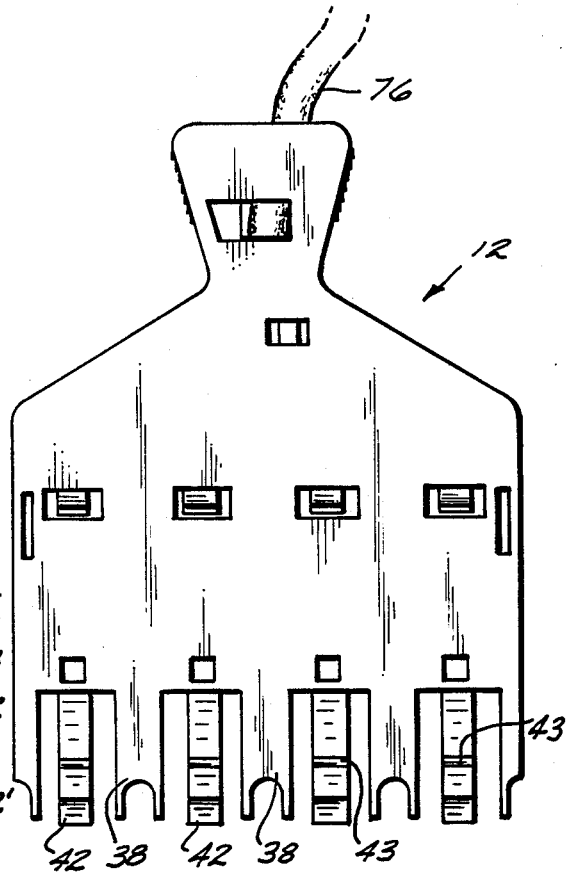
FIG. 4 is a bottom view of the lower portion of FIG. 3.
Figure 5:
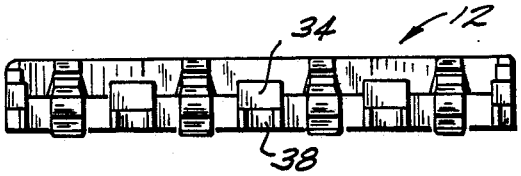
FIG. 5 is a front end view of the lower body portion of FIG. 3.
Figure 6:
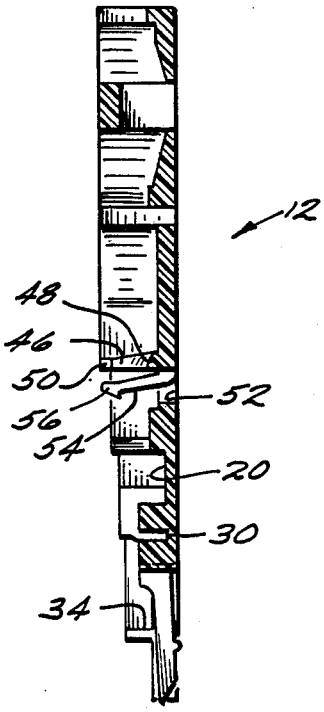
FIG. 6 is a cross sectional elevation view along the line 6—6 of FIG. 3.
Figure 7:
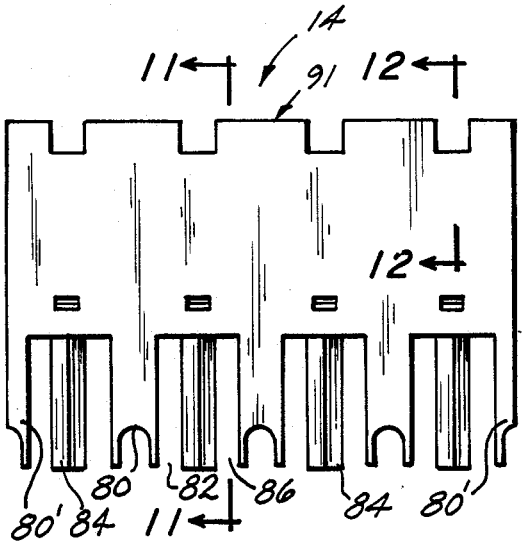
FIG. 7 is a bottom view of the cover of the patch connector of FIG. 1.
Figure 8:
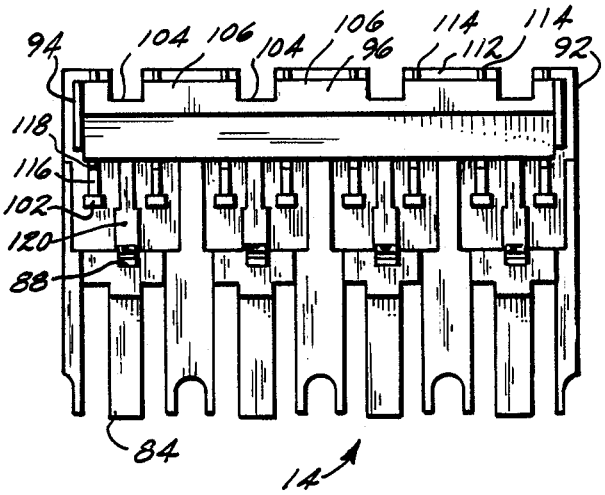
FIG. 8 is a plan view of the cover of FIG. 7.
Figure 9:
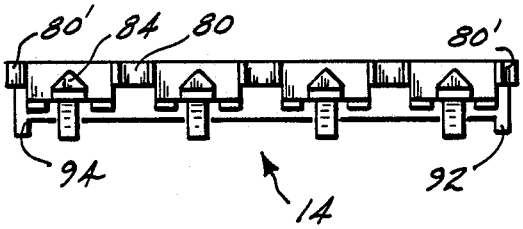
FIG. 9 is a front end view of the cover of FIG. 7.
Figure 11:
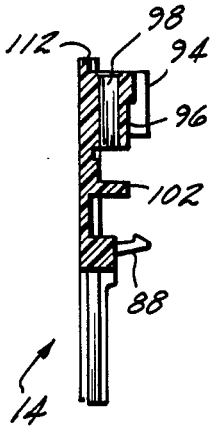
FIG. 11 is a cross sectional elevation view along the line 11—11 of FIG. 7.

As best shown in FIG. 4, blades 42 includes transverse ridges 43. These ridge 43 interact with a complimentary receptacle (e.g. detent) on a terminal block of the type disclosed in U.S. Ser. No. 144,040 filed Jan. 15, 1988 to thereby lock patch 10 to the terminal block.

As is clear from the FIGURES, that portion of patch connector 10 which is adapted to be received by terminals from a terminal block has a substantially rectangular configuration. However, from about the aligned tabs 46 at the mid-section of body portion 12, the configuration of patch connector 10 changes. In this area of body portion 12, the general shape of the body converges at converging sidewalls 58 to a rear section which preferably includes a strain relief mechanism. As is shown in FIGS. 1–4, and 13–15, the strain relief mechanism is located in a handle 60 which is used by the installer to install patch connector 10 onto a terminal block or the like. Handle 60 includes oppositely disposed serrated edges 62 which aid the installer in achieving a firm grip with patch connector 10. Within handle 60 is a opening 64 defined by two parallel sidewalls 66 and 67 (each sidewall 66 including serrated edges 62 thereon) and a pair of transverse walls 68 and 70. Transverse walls 68 and 70 each include aligned grooves 72 and 74 respectively for the purpose of receiving a cable (shown at 76 in FIGS. 1 and 4) therein. A lateral extension member 78 extends into opening 64 from sidewall 67. Lateral extension 78 is spaced from opposite sidewall 66. In this way, a cable 76 is placed onto recesses 72 and 74 and looped under lateral extension 78 as shown in FIG. 1. As a result, strain is relieved from cable 76 thereby avoiding serious problems stemming from disconnection of the conductors in cable 76 from the connector clips 16 as discussed hereinafter.

Referring now to FIGS. 7–12, the upper body portion or cover plate 14 will now be discussed. Cover plate 14 includes a front terminal portion and has a configuration which is substantically identical to the front terminal configuration of lower housing portion 12. Thus, cover 14 terminates in a repeating sequence of an elongated member 80 having a U-shaped end, a rectangular opening 82, a blade extension 84 and a rectangular opening 86. Also, as in housing portion 12, the pair of opposed end members 80' terminate in a ½ U configuration. Note however that rather that the flattened blade shape of member 42, corresponding member 84 has a triangular shape.

The triangular cross-section of members 84 are important when patch 10 is used on a terminal block of the type disclosed in U.S. Ser. No. 144,040 filed Jan. 15, 1988. This cross-section configuration acts as a polarizing means to correctly orient the patch 10 on a terminal block.

Cover 14 also includes four spaced upstanding resilient latches 88 (see FIG. 11), one each of latches 88 being in alignment with one of the blade extensions 84. Each latch 88 is configured to be received in and snap lock to a corresponding opening 36 in lower housing 12. It will be appreciated that during assembly of patch connector 10, resilient latches 88 are received within opening 36 of body portion 12 whereupon latch member 88 will outwardly deflect and then snap back and be retained by wall 90 in housing portion 12.

Figure 13:
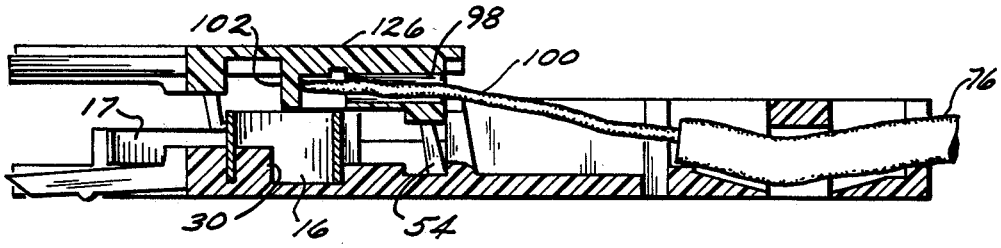
FIG. 13 is a cross sectional elevation view of the patch connector of FIG. 1 shown connected in a first detent position.

Cover 14 also includes a rear face 91 which communicates between a pair of depending side faces 92 and 94. Between depending arms 92, 94 is a block 96 which includes a plurality of cylindrical openings 48 therethrough. As shown in FIG. 13, openings 98 are sized to receive a conductor 100. Spaced a preselected distance from the outlet of each cylindrical opening 98 is a plurality of discrete and spaced retaining walls 102 which act as stops to the conductors 100 which have been brought through each cylindrical opening 98. Each retaining wall 102 also acts to further align and retain a connector clip during assembly. The rear face of block 96 is defined by four spaced recesses 104 with an extended section 106 on either side of each recess 104. The three internal extended sections 106 each have a pair of cylindrical openings 98 therethrough. The outermost extended sections 106' each have a single cylindrical opening 98 therethrough.

Figure 12:
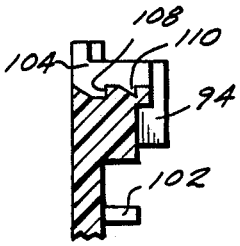
FIG. 12 is a cross sectional elevation view along the line 12—12 of FIG. 7.
Figure 10:
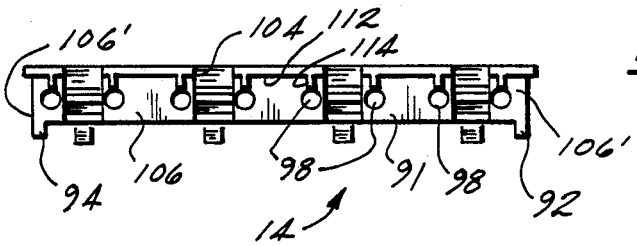
FIG. 10 is a rear end view of the cover of FIG. 7.

Referring to FIG. 12, recess 104 includes an upper shoulder 108 and a lower shoulder 110, both of which interact with resilient detents 56 to effect a dual detent closure as will be discussed hereinafter.

Each extended portion 106 of block 96 includes an overhanging lip 112. A plurality of ridges 114 transverse to lip 112 are positioned on lip 112 in alignment with each cylindrical opening 98.

Cover portion 14 also includes connector clip alignment ridges 116 and an associated recess 118 (aligned with ridges 116) for engaging the stripping slot of a connector clip. Finally, cover 14 includes a raised member 120 positioned between each ridge 116 which is commensurate with the shape of member 24 in lower housing 12 and is intended to mate with member 24 during assembly.

As seen in FIG. 2, connector clip 16 includes a rectangular box-like body 15 having an insulation displacement (IDC) slot 122 therethrough. Resilient contact member 17 extends outwardly from body 15 at an angle to a reverse angle bend 124. Connector clip 16 is easily manufactured from a single strip of conductive metal by known stamping and forming methods.

Figure 14:
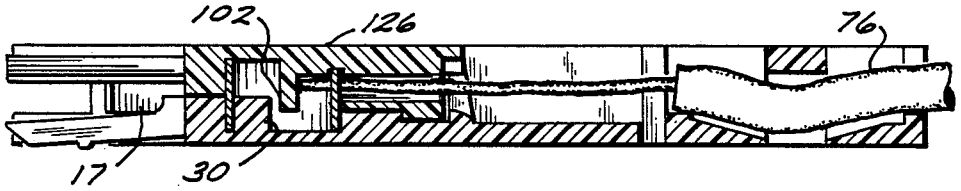
FIG. 14 is a cross sectional elevation view of the patch connector of FIG. 1 shown connected in a second fully closed position with wires in place.

Turning now to FIGS. 2 and 13–14, assembly views of the patch connector of the present invention are shown. In FIG. 2, an exploded view is shown prior to assembly wherein a plurality (in this case eight) of connector elements 16 are loaded into each connector housing section 18. Each clip 16 will be rigidly contained within a recess 20 and held between the four walls 22, 24, 26 and 28 and extension 30. Contact 17 will pass through groove 32 so as to expose bend 124 within one of the opening 40 or 44.

Next, top body portion or cover 14 is suspended over lower body section 12 such that resilient latches 88 align with the openings 36 and detents 56 are aligned with the respective shoulders 108, 110 in recess 104 on cover 14.

As shown in FIG. 13 resilient detents 56 are received in recesses 104 of cover 14 such that the detents 56 snap lock onto shoulders 110 to define a first detent position. At this first preliminary detent position, jacketed or unjacketed cable wire 76 may be fed into body portion 12 through the strain relief means as shown in FIG. 13. Next, the individual conductors from cable 76 are separated and loaded into each of the cylindrical openings 98 as shown in FIG. 13. Each conductor 100 will protrude outwardly from cylindrical opening 98 a preselected distance which is governed by the stop wall 102. It will be appreciated that openings 98 will align each conductor 100 so that conductors 98 are suspended directly over an insulation displacement slot 122 on connector clip 16.

Next, as shown in FIG. 14, pressure is exerted on top surface 126 of cover 14 whereby resilient detents 56 will be deflected outwardly and then snap down into a second detent position. In the second detent position, the shoulder identified at 108 in recess 104 will be in contact with detent 56 to define a second, final detent position. In addition, resilient latches 88 will also be deflected and then snap locked so that latches 88 from cover 104 are retained in openings 36 of lower housing 12. It will be appreciated that between the first and second detent positions, each of the conductors 100 of cable 76 will be forced through slots 122 of connector clips 16 whereby the insulation will be displaced from the conductors and a strong electrical and mechanical connection between each conductor 100 and each clip 16 will be effected. At this point, patch connector 10 of the present invention is fully assembled and is ready for use in conjunction with a terminal block or the like.

Upon assembly, the finger-like front ends of both housing portion 12 and cover 14 will mutually align so that each U-shaped member 38 and 80, each blade member 42 and 84, each rectangular opening 40, 82 and 44, 86 are in the corresponding relationship shown in FIG. 1. The respective finger-like members 38, 42 on housing 12 and finger-like members 80, 84 on cover 14 will be separated from each other by a spacing approximately equal to the thickness of T-shaped wall 34.

Also upon assembly, each overhanging lip 112 will be positioned between a pair of tab extensions 50 with tab extensions 50 being positioned in the recesses 104.

Figure 15:
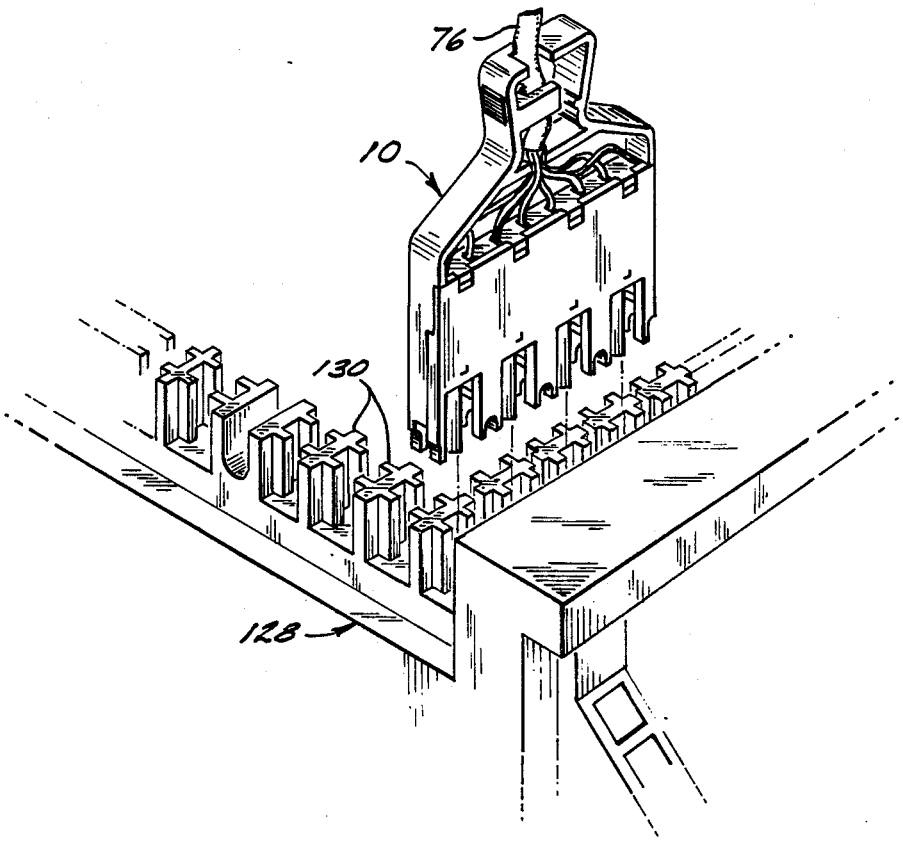
FIG. 15 is a perspective view depicting the patch connector of FIG. 1 prior to connection to a terminal block.

Patch connector 10 of the present embodiment is particularly well adapted for use in conjunction with a terminal block 128 such as shown in FIG. 15 and more fully described in U.S. patent application Ser. No. 144,040 filed Jan. 15, 1988. Thus, the rectangular openings between spaced pairs of finger-like members (which are now loaded with connector clips 16 and electrically connected to a cable 76) are aligned with the requisite number of terminals (in this case eight) in the block and the patch connector is then inserted (using finger grips 62) onto the terminal block whereby mechanical and electrical connection is made between the resilient connector clips 16 and the terminals (not shown). It will be appreciated that the finger-like projections 38, 42, 80, 84 extending from the front face of patch 10 will be received by and slidingly cooperate with the channels formed by the plurality of upstanding double cross members 130 in block 128.

Of course, patch connector 10 may comprise any number of connector clips and associated clip holding cavities and will usually comprise an even number of said cavities. Presently, in the communications industry, 1, 2, 3 or 4 pairs are normally used. However, other combinations of bridge clips and cavities are contemplated by and encompassed by the present invention.

Figure 16:
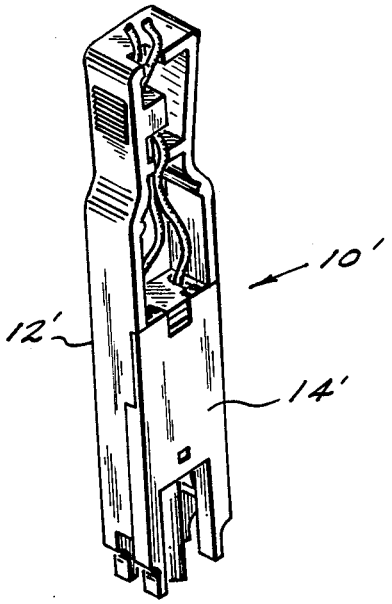
FIG. 16 is a perspective view of an alternative embodiment of the patch connector of FIG. 1.
Figure 17:
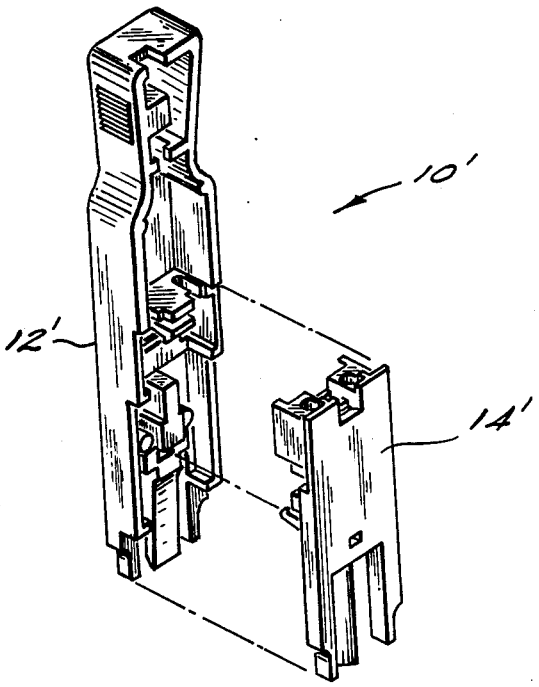
FIG. 17 is an exploded perspective view of the patch connector of FIG. 16.

An example of such an alternative embodiment of the present invention is shown at 10' in FIGS. 16 and 17 where like elements have been numbered alike with the addition of a prime. Of course, this alternative embodiment is used in conjunction with one pair of connector clips.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A patch connector for accessing at least a pair of terminals extending from a terminal block comprising:

housing means including a first housing portion attachable to a second housing portion, said housing means having a front and a rear;

at least a pair of recesses in said second housing portion, said recesses defining at least a pair of electrical connector clip chambers;

a discrete electrical connector clip in each of said electrical connector clip chambers;

a plurality of first spaced extension members extending outwardly from a front edge of said first housing portion; and a plurality of second spaced extension members extending outwardly from a front edge of said second housing portion, said first and second extension members being substantially coplanar and mutually aligned to define a repeating sequence of openings sandwiched between coplanar pairs of said first and second extension members wherein said connector clips communicate with said openings.

2. The patch of claim 1 wherein:

at least one of said aligned first and second extension members terminate in a U configuration.

3. The patch of claim 2 wherein:

the outermost first and second aligned extension members terminate in a ½ U configuration.

4. The patch of claim 1 wherein:

at least one of said first extension members has a flattened blade configuration.

5. The patch of claim 1 wherein:

at least one of said second extension members has a triangular cross section.

6. The patch of claim 1 wherein said connector clip comprises:

a rectangular body portion; and a resilient longitudinal member extending from said body portion and into said openings.

7. The patch of claim 6 including:

a reverse bend section in said resilient longitudinal member; and a shoulder in said first housing portion for abutment with said reverse bend section.

8. The patch of claim 1 including:

support means for supporting and aligning said connector clips in said chambers.

9. The patch of claim 1 including:

means for attaching said first and second housing portions in at least two positions including a preliminary conductor loading position and a final closed position; and at least a pair of spaced conductor retaining means in said first housing portion, each of said retaining means adapted to align a conductor in a preselected position when said first and second housing portions are attached in said preliminary position.

10. The patch of claim 1 wherein:

said means for attaching said first and second housing portions in at least two positions comprise first snap action connecting means.

11. The patch of claim 10 wherein said first snap action connecting means comprise:

at least one resilient arm depending from said first housing portion, said arm including detent means; and a pair of vertically displaced shoulders in said second housing portion, said pair of shoulders cooperating with said detent means to define said preliminary and final positions.

12. The patch of 11 including:

at least one tab extending upwardly from said first housing portion;

a pair of wire guide grooves on opposed sides of said tab; and said resilient arm extending upwardly jfrom the base of said tab at an angle.

13. The patch of claim 12 including:

a tab extension having a narrower width than said tab extending outwardly from said tab.

14. The patch of claim 12 including:

an aperture through said first housing portion adjacent said tab, said resilient arm extending over said aperture.

15. The patch of claim 13 including:

a plurality of spaced tabs with said tab extension extending from alternating tabs.

16. The patch of claim 1 including:

spaced conductor retaining means in said second housing portion, said retaining means comprising cylindrical openings through a wall of said first housing portion.

17. The patch of claim 16 including:

spaced, discrete stop means depending from said second housing portion for preventing conductor travel, said stop means being spaced from said exit section.

18. The patch of claim 1 including:

at least one transverse ridge on one of said first extension members.

19. A unitary connector clip, comprising:

opposed, substantially planar first and second lateral members, each lateral member having a top end and a bottom end, said lateral members being joined at their bottom ends and said top ends being inwardly curved to define a slot therebetween;

an elongated contact member extending outwardly from the bottom end of the first lateral member to a free end; and a reverse bend region near the free end of the contact member;

said unitary connector clip being formed from a single strip of conductive metal.

* * * * *